US009834027B2

(12) United States Patent
Bracher et al.

(10) Patent No.: US 9,834,027 B2
(45) Date of Patent: Dec. 5, 2017

(54) METHOD FOR THE PRODUCTION OF A PRINT JOB

(71) Applicant: Mueller Martini Holding AG, Hergiswil (CH)

(72) Inventors: Markus Bracher, Pfaffnau (CH); Daniel Lutziger, Birmenstorf (CH); Markus Schluep, Zofingen (CH); Stefan Bulgheroni, Wikon (CH); Roland Rotach, Zofingen (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/041,151

(22) Filed: Feb. 11, 2016

(65) Prior Publication Data

US 2016/0231968 A1 Aug. 11, 2016

(30) Foreign Application Priority Data

Feb. 11, 2015 (CH) ..... 182/15

(51) Int. Cl.
*B42C 19/02* (2006.01)
*B42C 19/04* (2006.01)
*B42C 19/06* (2006.01)

(52) U.S. Cl.
CPC ..... *B42C 19/02* (2013.01); *B42C 19/04* (2013.01); *B42C 19/06* (2013.01)

(58) Field of Classification Search
USPC ..... 358/1.13
See application file for complete search history.

(56) References Cited

U.S. PATENT DOCUMENTS 4,390,952 A * 6/1983 Dlugos ..... G06Q 99/00 177/25.15
6,088,710 A * 7/2000 Dreyer ..... G06F 17/211 715/246

(Continued)

FOREIGN PATENT DOCUMENTS

EP 2314533 A1 4/2011
EP 2457859 A1 5/2012

(Continued)

OTHER PUBLICATIONS

Dieter Liebau & Inés Heinze: "Industrielle Buchbinderei", Dec. 2001, Verlag Beruf + Schule, Itzehoe, XP002739074, pp. 1-28.

(Continued)

*Primary Examiner* — Ngon Nguyen
(74) *Attorney, Agent, or Firm* — Leydig, Voit & Mayer, Ltd.

(57) ABSTRACT

A method for the production of a print job by sequential or quasi-sequential digital printing includes forming at least one stack including signatures, print sheets and/or individual sheets produced by the digital printing. Components of the stack are transferred at least to a book-related printed product by means of at least one additional processing. The formation of the stack and the components thereof is carried out by means of production-related data or data sets which, by means of at least one workflow system, firstly select a specific sequence of individual book-related printed products made of the stack, and which secondly control a layout of the individual main printed products having same or different thicknesses and/or formats and/or having same or individual contents.

21 Claims, 1 Drawing Sheet

(56) References Cited

U.S. PATENT DOCUMENTS

| | | | | |
|---|---|---|---|---|
| 2001/0055123 | A1* | 12/2001 | Ryan | G06Q 10/06 358/1.12 |
| 2005/0098935 | A1* | 5/2005 | Sittinger | B42C 19/02 270/32 |
| 2010/0165407 | A1* | 7/2010 | Witkowski | B42D 15/02 358/1.18 |
| 2012/0029825 | A1* | 2/2012 | Cho | G01V 3/15 702/6 |
| 2014/0024512 | A1 | 1/2014 | Grunder et al. | |
| 2014/0211249 | A1 | 7/2014 | Bracher et al. | |

FOREIGN PATENT DOCUMENTS

| | | | |
|---|---|---|---|
| EP | 2749419 | A1 | 7/2014 |
| EP | 14151766 | A2 | 7/2014 |

OTHER PUBLICATIONS

Helmut Kipphan: "Handbook of Print Media", Dec. 2000, Springer Verlag, Berlin / Heidelberg / New York ISBN: 3-540-66941-8.

* cited by examiner

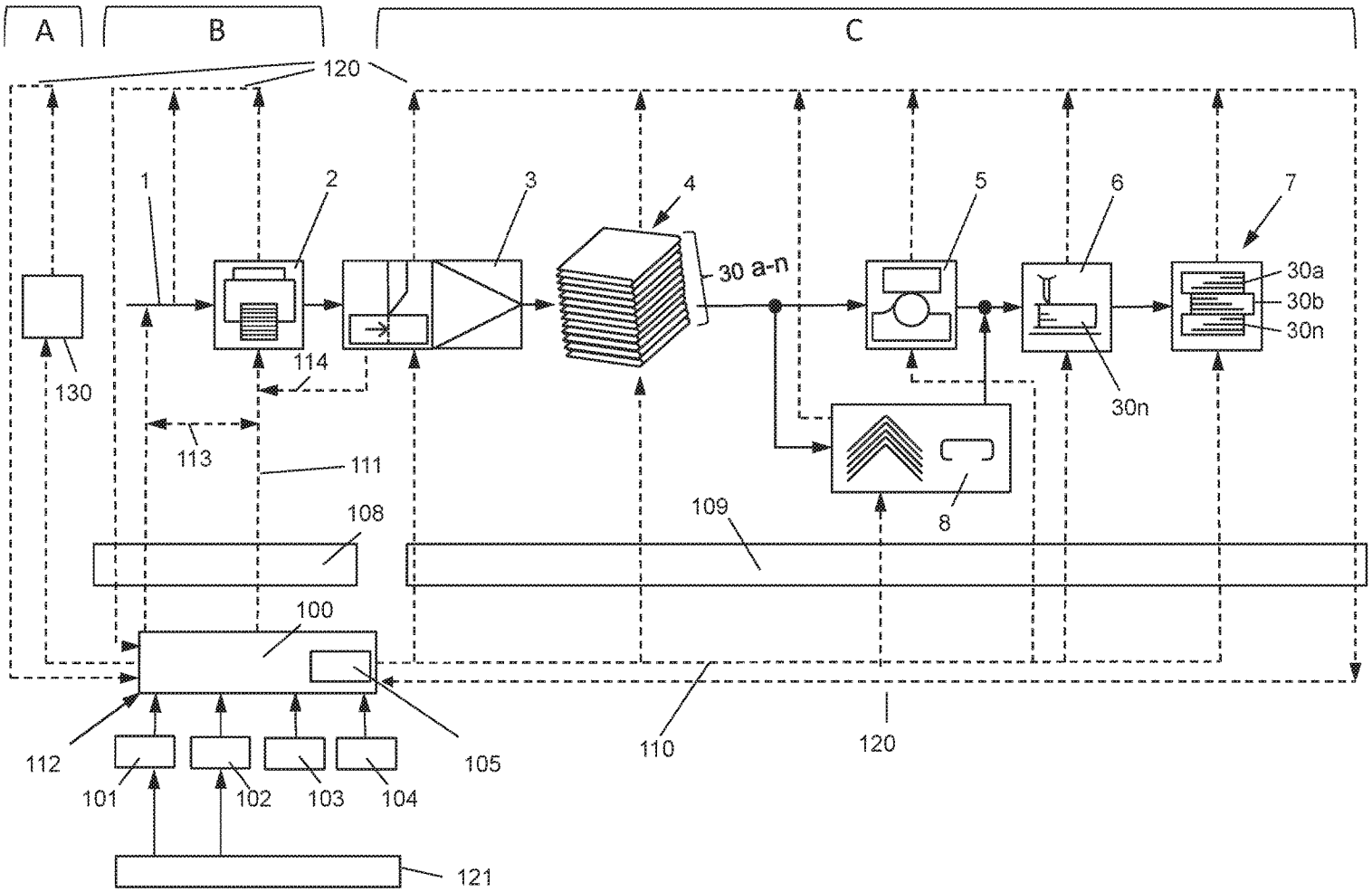
A
B
C
120
130
1
2
114
113
3
4
30 a-n
111
108
109
5
8
6
30n
7
30a
30b
30n
100
105
104
103
102
101
112
110
120
121

METHOD FOR THE PRODUCTION OF A PRINT JOB

CROSS-REFERENCE TO PRIOR APPLICATION

Priority is claimed to Swiss Patent Application No. CH 00182/15, filed on Feb. 11, 2015, the entire disclosure of which is hereby incorporated by reference herein.

FIELD

The invention relates to production systems for the inline processing of digitally printed signatures/print sheets, primarily in the continuous web region. The invention additionally relates to digital printing systems using inline processing, specifically in the forms "book block or booklet production", in particular, but not exclusively: perfect binders, gathering machines, saddle stitchers, inline book production, buffer systems, etc. All configurations are controlled by workflow control systems. All the systems mentioned belong to the prior art, and can be retrieved for example from the homepage of the MUELLER MARTINI group, and thus form an integral part of this description.

By means of digital printing, any desired sequences can be printed. This makes it possible to optimise productions to the effect that the logistics are brought to the fore. It is possible for example to print books sorted according to orders. This eliminates costly temporary storage processes. It is also possible to produce individual and personalised products in one edition, e.g. personalised guide books. There is a new requirement in this case to control productions having variable thicknesses and contents, and this places specific requirements on the processing machines and on the data management. In the industry, such applications are known under the name "VDP" (variable data printing).

Thus, the invention also relates to a method for the production of a print job by sequential or quasi-sequential digital printing, wherein the signatures and/or individual sheets produced by the digital printing form at least one stack, the components of which are transferred at least to a printed product by means of at least one additional processing.

BACKGROUND

EP2314533 A1, which is hereby incorporated by reference herein in its entirety, discloses a production process in which the paper web is divided up into a variable number of print-specific partial webs according to a first format size of the finished printed product, wherein each of said partial webs is sequentially printed on both sides. Subsequent to the printing phase, the paper web is continuously cut in the transverse direction in such a way that each portion length forms a multiple of a second format size of the finished printed product. These partial webs, individually or in combination with one another, are then folded transversely at least once, and these are then cut in the longitudinal direction of the paper web, according to the width of the printed product, wherein it is also possible to carry out the folding after the partial webs have been formed.

A first embodiment consists in firstly one or more folds being carried out over the entire width of the printed paper web; then, after the fold(s) has/have been carried out, the individual print sheets are cut to a specific width in the longitudinal direction of the paper web and then each supplied to a stack. Thus, if the width of the paper web is divided up for example into four longitudinal paper webs, this results in four parallel stacks.

An additional embodiment consists in the partial webs firstly being cut in the longitudinal direction of the paper web before the folds are carried out, i.e. the folding is carried out in this case transversely to the cuts already carried out in the longitudinal direction of the paper web and affects a number of print sheets which corresponds to the number of partial webs created previously. Thus, if double or multiple folding is taken as a basis, then four double-sided, or eight double-sided printed pages are combined in each case. Regardless, the cuts in the longitudinal direction of the paper web can also be carried out in this case before or after the folds, similarly to the above explanations in the case of a single fold.

In the domain of selective binding in saddle stitchers, it is known to stack packages according to predefined lists. This generally takes place by means of selective binding controllers, which are managed by means of control systems. Said systems control both the compilation of the products by selectively activating the feeders, and the formation of the packages in the crosslapper/stacker. The package formation can be carried out by means of control signals from the controller or by means of printed marks.

EP14151766.4, which is also hereby incorporated by reference herein in its entirety, discloses a printing system which involves knowing about the internal processes in the production and processing of printed products. In particular, precise stop positions are known, and the printing system knows at all times which print sheets have been printed completely or incompletely. Likewise, additional organisational information is also known or can be obtained immediately, i.e. by means of this printing system, the available data for the processing are made accessible at a suitable time and in a substantively accurate manner.

For this purpose, a method is proposed for recording and transferring organisational data before and/or during a printing process when producing printed products in a printing machine, which is preferably a digital printing machine, wherein said data are recorded on the basis of distinguishing features which are operatively connected to at least one printed product, referred to in the following as a printed mark, wherein the data resulting from the printed mark are transferred and/or transmitted to at least one processing unit which is connected downstream of the printing process. During the integral printing process, a first transmission of data is carried out, which data are used for at least one redundant check of the data resulting from the printed mark, which mark preferably relates to a printed product, i.e. are vital for the processing of the printed products.

Printed marks having product-related data include inter alia information about cross-cutter control based on cutting marks or book separation based on separating marks. It goes without saying that printed marks can also record other product-related data. During the printing process, according to the invention, at least one redundant check of the product-related data resulting from the printed mark is thus carried out, with the aim of establishing the extent to which said data conform to the effective data recorded or transmitted from the printing process.

Furthermore, in the domain of postroom equipment, methods are disclosed which make it possible to form predefined packages, e.g. based on postal routes or delivery points.

SUMMARY

In an embodiment, the present invention provides a method for the production of a print job by sequential or quasi-sequential digital printing. At least one stack including at least one of signatures, print sheets and individual sheets produced by the digital printing is formed. Components of the stack are transferred at least to a book-related printed product by means of at least one additional processing. The formation of the stack and the components thereof is carried out by means of production-related data or data sets which, by means of at least one workflow system, firstly select a specific sequence of individual book-related printed products made of the stack, and which secondly control a layout of the individual main printed products having same or different thicknesses and/or formats and/or having same or individual contents.

BRIEF DESCRIPTION OF THE DRAWING

The present invention will be described in even greater detail below based on the exemplary FIGURE. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 shows a production process of printed products which are produced and processed according to particular criteria.

DETAILED DESCRIPTION

In an embodiment, the present invention addresses the previously unknown problem of proposing production of variable printing products in the case of a method of the type mentioned at the outset in conjunction with a digital printing machine.

An embodiment of the invention relates in this case to forming the stack and the components thereof by means of production-related data or data sets, which, by means of at least one workflow system, firstly specify a specific sequence of the individual printed products formed by the stack, and which secondly control the layout of the individual printed products having the same or different thicknesses and/or formats and/or having the same or individual contents.

The printed products, which form the components of the stack formed downstream of the digital printing machine, normally consist of signatures, print sheets and also of individual sheets, from which books, book blocks and booklets etc. are then formed by means of processing.

In the present case, the operational processes relating to the pre-press, digital printing and the processing machine are not described according to the sequence, because otherwise existing interdependencies in operative connection with the workflow system could not be explained with the necessary consistency and clarity.

The system according to an embodiment of the invention is thus substantially based on a workflow system which controls the components pre-press, digital printing and processing and processes information from the operation of said components for a specific purpose.

In the case of the pre-press, the created JDF (job definition format) is transmitted automatically to the pre-press after having been created. Said pre-press reads the relevant processing parameters from the JDF, fetches the PDF(s) (customer input(s)) according to at least one link in the JDF, and imposes said PDF(s). The result is an imposed PDF file. The successful imposition is reported back to the workflow system. The pre-press thus codes the printed products according to the codes specified by the editor (JDF editor/job folder editor).

The codes are therefore of central importance for the product tracking between the pre-press (see below) and the printing system (digital printing machine) on the one hand and the processing (processing machines) on the other hand. Accordingly, said codes have to be specified at a level which is higher than the mentioned subsystem.

In this case, there are two ways in which the codes can be printed:

The above-mentioned workflow system, in the sense of a connection and/or linking of job-accompanying data, receives the data from an upstream system, checks said data and carries out corrections if necessary (e.g. in the case of packages which are too large or too small). The workflow system then makes the corrected run list available to the pre-press, which prepares the codes based on this specification.

This workflow system is a digital system by means of which complete cross-linking of subprocesses can be ensured. Furthermore, by means of this system, not only individual machines but also complex, different, and client-specific production systems can be cross-linked, i.e. even production systems and machines from various suppliers. Thus printed-product-related processing subprocesses can also be electronically cross-linked in such a way that the data generated in the pre-press or during printing can be transferred.

It can thus be established that various modules belong to this digital system, which modules control and manage the entire workflow system, i.e. from the display of stored information, via the creation of new job tickets, production control and display of job tickets through to the integration of existing lines (production lines) into the overall digital work process. This means that by assigning a specific job ticket to a machine or system, the required format data are automatically transmitted.

Furthermore, the job tickets can be defined by adding and/or removing actions, wherein the actions themselves can be modified, deleted or recreated. In order to avoid collisions, each action, whether present in the original state, introduced subsequently or changed, has to include a correct status which firstly authorises or implements such an action.

In this case, the above-mentioned workflow system consists of various modules which are responsible, either individually or in any desired combination, for the individual production steps, namely:

A module makes sure that the production is transparent in that it allows an uninterrupted overview of the production lines and status of the respective jobs. In addition, the entire production can be displayed and analysed by means of graphs.

An additional module makes it possible to create and edit jobs for clients.

An additional module makes it possible to schedule jobs in the sense of sorting, grouping and planning. Jobs can be assigned to machines automatically or manually. In this case, machines which do not necessarily have a workflow system connection can also be recorded.

An additional module records and collects the operating data resulting from the processing, which data can then be retrieved continuously.

An additional module supplies and collects data for printing package cover sheets and logistics documents, which correspond to the effectively produced printed products or packages.

An additional module is constructed in such a way that it checks the correctness of the individual above-mentioned modules in the case of the operational implementation thereof in isolation or interdependently with respect to one another in that it checks for example how an individual action in combination with the modules affects the underlying production.

The workflow system thus spans all of the production aspects of the overall system according to the following criteria:

In the case of an initial job, one or more PDFs (customer inputs) and/or one or more PDF/VTs (data formats for additional meta data) are used to process the targeted printed products having fixed or variable contents, thicknesses and formats.

When preparing the work, either a job folder is created in the editor of the workflow system, or an MIS (management information system) sends a gray box JDF (job definition format) to the workflow system.

In this case, there is a choice between two procedures:

a) Firstly, in conjunction with the editor: The operator on the workflow system starts the editor by selecting a production template. The production template contains (basic) information about the type of the desired production (book block, book, booklets, etc.).

In the editor, the operator selects the PDF(s) and/or PDF/VT(s), selects the paper and can optionally select additional parameters such as the colour profile of the printing machine and desired printed marks (codes), etc.

On this basis, the editor creates a JDF (job definition format) in the sense of a job folder.

b) Secondly, in the case of an import of the gray box JDF: In the gray box JDF, there is a reference to the PDF(s) to be produced and to the relevant paper sizes and printing settings. The workflow system reads these values and, on this basis (similarly to the above-described case under a) expands the gray box JDF to a JDF.

According to the invention, the MIS (management information system) can thus send the workflow system not only a gray box JDF, but also at least one run list.

A run list contains generally applicable information for the process, namely:

As already set out above, the workflow system receives the data transmitted from an upstream system, checks said data and carries out corrections if necessary (e.g. in the case of packages which are too large or too small). Said system then makes the corrected run list available.

The run list is acquired directly from an upstream system.

Furthermore, the PDF/VT contains information (meta data) which allow the editor to create a run list.

The editor can interpret the run list accordingly and supplement the PDF/VT with additional meta data intended for the pre-press. In particular, the editor calculates the signatures, book blocks, books etc. to be produced, and the corresponding codes are implemented for all of the units (see the previous definition).

With regard to the production of the printed products (see above) the JDF (job definition format) is sent from the workflow system to a print manager (digital front end), which then controls the digital machine accordingly. At the same time, the JDF is also sent to a line control in conjunction with the processing, which in turn controls the arranged processing machines accordingly.

Optionally, the processing machines can directly or semi-directly receive, interpret and accordingly adjust the JDF.

This results in the precept that the production can only be started when all of the machines involved in the production are on standby and have provided feedback.

Proceeding from these premises, the unit(s) forming the printed product (saddle stitchers, perfect binders, book sewing machines) receive the above-described information at the start of the line. The information is forwarded via the internal product tracking through to the package-forming modules. The information contains control codes relating to the package formation and optionally relating to the continuous or subsequent layer formation.

A gathering machine which is used optionally has auxiliary gluing of the stacked print sheets and signatures or individual sheets. This function is used to fix a loose stack so that a manageable connected package is produced from printed products. In the operating mode, the auxiliary gluing is controlled selectively so that a stack of fixed printed products can be produced.

Then, by means of the possibilities of digital printing, an additional component having distinguishing features is produced which differs from conventional selective binding applications, namely:

By means of digital printing, any desired sequences of any desired content can be produced. The products produced one after another thus do not have to have any relation to one another in terms of content. In the case of selective binding, the machine uses a predefined set of signatures which are individually compiled to form products. The number of possible products thus results from the possible combinations and permutations of the original subproducts.

As already explained above, the invention comprises at least one circuit, in which the input format no longer consists only of a (standard) PDF (customer input), but rather also consists of a PDF/VT data format.

This (PDF/VT) contains, in addition to the PDF-based content pages, additional meta data which contain the individual composition of the products in the form of data sets (records). It is thus a combination of the print content and the addressee database.

With regard to PDFNT, a distinction is generally made between various levels of conformity, namely:

A PDF/VT-1 is intended for exchanging a single, complete file. The file contains all the resources and contents which are required for error-free interpretation of the file.

A PDF/VT-2 allows the exchange of files which refer to external ICC profiles and external page contents.

Other PDF/VT variants are possible which allow specific and additional meta data to be influenced during processing.

The advantages of these PDF/VT formats are that they allow inter alia more reliable printing processes of colour systems by comparison with conventional printing processes used today. However, this assumes that the entire process chain carries out this colour printing in high quality, and is transmitted with corresponding codes.

Furthermore, the PDF/VT formats allow a great deal of flexibility in the organisation of meta data. In the case of mass sending, it must be ensured for example that the contents can be grouped according to recipient, postcode or gender so that they can be placed in an envelope or sent. In this case, for example different numbers of pages, different text blocks or different graphical elements have to be taken into consideration.

Another advantage of the PDF/VT formats is that it is possible to support data streams. In this case, pages, page regions and resources are written to a continuous data stream and are integrally or quasi-integrally passed on to the printing server.

By means of the PDF/VT input, the job is prepared and created, namely:

1. The meta information is analysed;
2. A run list is formed from the data sets;
3. The run list is checked with respect to the specification limits relating to the processing and the printing system;
4. The blank pages per product are calculated:
5. Corrections are made to the run list if necessary (e.g. package definition, can be carried out automatically or manually);
6. The required barcodes are generated based on the corrected run list (e.g. package/layer definition);
7. The corrected run list is either cached with additional information in the workflow system or preferably rewritten in the PDF/VT format;
8. The PDF/VT format is delivered to the pre-stage solutions together with the JDF job ticket;
9. The command language in operative connection with the JDF job ticket ensures that the production is planned and controlled accordingly;
10. The pre-press calculates the individual print sheets in the individual compositions thereof from the PDF/VT format (which now contains extensive, corrected meta data);
11. The print sheet data is (conventionally) transmitted to the printing machine for rasterization.

An important property of the data introduced is that the data used for the pre-press and the calculations/checks in the workflow system are the same and thus complete and precise data which are required for the format settings for processing.

Furthermore, the method according to the invention also comprises the following essential aspects:

The input data format information is transferred as single-page files and implemented in job tickets.

The input data format information, as the pre-press, triggers an imposition in which:

The format data relating to predefined web widths/product types which are dynamically optimised according to a set quality standard;

Additional visual markings or texts are added in the paragraph or viewing region, in order to make it possible for the operator to recognise and assign the subproducts/final products.

The input data and/or process-relevant information are implemented according to the underlying PDF/VT format in each case.

The PDF/VT format is correspondingly expanded according to one of the tools mentioned (VT-1; VT-2, etc.)

On the basis of at least one job ticket or JDF format (job definition format), the workflow system generates additional product-related data, for example a job header, production instructions, planning information, event list, etc.

The JDF format therefore fulfils the function of an electronic job ticket and extends over the entire life cycle of a product. It is important to note that the JDF format contains only references, i.e. links, each JDF format being able to contain additional intersections which can lead to nesting, by means of which the production-related degree of coverage of a JDF format of this type can be expanded to a maximum.

The data in the job ticket or in a PDF/VT format are cached and/or passed on as print sheet data, wherein the data enter as barcodes, and wherein the barcodes have a PDF, PDF/VT, JDF, run-list or job-ticket-related coding.

Contrary to the prior art, in this case, in terms of data, it is not a forward strategy (job ticket>pre-press>printing>processing) which is used, but rather a backward strategy (job ticket for processing>pre-press>printing).

This has the great advantage that the pre-press can be adapted very variably and individually for each configuration of the processing.

An additional extension of the method according to the invention consists in also embedding, in addition to the product body, the cover in a file in the input PDF/VT format. As a result, the cover can also be variably assigned to the products on the basis of the meta data. In this case, the content of the cover can be exchanged as a whole, and can also contain one or more objects which can be varied in themselves (logos, title, addresses, etc.).

In the context of the processing in the workflow system, the cover data can also be extracted and a corresponding cover production can made available in the form of a PDF/VT format, a job ticket and/or run lists. In this case, there are various conceivable scenarios: for example, inline production of the covers by means of the processing unit (e.g. perfect binder) based on the identified supplied book blocks or based on a run list. The covers could also be prepared in a near-line or offline manner based on the above-mentioned data sources.

Thus, during the production and formation of the variable printed products, various job-accompanying data can be implemented automatically, which can be used as input data format information for the controlled production and formation of the variable printed products and which refer to the individual compositions of the individual printed products.

Furthermore, the input data format (PDF) is simultaneously or intermittently supplemented with additional data formats (VT-1, VT-2 etc. and with JDFs, job tickets and run lists). Furthermore, the above-described workflow system intervenes, which continuously checks, adapts, provides feedback to and optimises the implemented job-accompanying data.

As a conclusion, it can thus be stated that the PDF/VT formats overall form a basis for the method according to the invention, where all available means are used in terms of printing within the method defined in the claims, wherein the PDF/VT formats also support all the print jobs regardless of whether they contain variable data with respect to the compositions of the individual print jobs. This also applies to any case in which the PDF/VT formats are additionally supplemented with other job-accompanying data and/or data formats.

In summary, it can thus be established that the production consists of interdependent cooperation between the pre-press, printing and processing, the processes of which are controlled, monitored and adapted directly or semi-directly by a workflow system.

By means of the invention, as has been explained in detail above, various production types can therefore be implemented, wherein it is not so much volume production or individual copy production which is in the foreground, but rather the focus is substantially on individual production in which a series of similar or quasi-similar or different types of printed products is at the centre. These printed products are characterised by a content which has a high degree of reusability, but which contains one or more individualised content elements.

It is also possible to have a selective composition based on chapters. Typical applications for this are guide books, insurance documents, test booklets and teaching materials.

In the case of teaching materials, it is then still possible to provide the individual printed products as chapters, lessons or courses in sequence in the form of a connected stack. This production is based in this case on data processing, as can be seen from the embodiments above.

The development of the invention with respect to the closest prior art thus consists in the fact that the formation of a printed product stack and the components thereof is carried out by production-related job-accompanying data, which firstly specify a specific sequence of the individual printed products formed by the stack, and secondly control the layout of the individual printed products having the same or different thicknesses and/or formats and/or having the same or individual contents, and in the fact that the individual printed products are provided with additional information, which provide information about completeness and/or required repairs.

By means of the process, all subproducts are clearly tracked and processed to form larger subproducts or ultimately made into final products. The state of every entity is known at all times. A poor signature thus leads to a poor book block in the transformation, which in turn can lead to a poor or incomplete package. In addition to the information about the quality of a product or subproduct, the product tracking can also contain information about the package formation or additional logistical actions.

Tracking the status of the printed product is closely linked to possible repair scenarios which are to be provided according to requirements. The following approaches can be provided:

1) Combining the repair copies in a separate job, product at the end of the current job or at a separate repair time.

2) Prompt feedback and feeding back into the printing process. Manual or automatic insertion of the repair copies into the defective product stream or packages.

3) Prompt report to a repair printer close to the repair location. Manual or automatic insertion of the repair copies into the defective product stream or packages.

4) A defective or deficient printed product is subsequently produced and subsequently delivered directly to the printed-product-related defective point in the processing station via at least one independent supply line, for example according to EP2749419 A1, wherein this document forms an integral part of the present description.

5) A specific repair method for example according to EP2457859 A1, wherein this document forms an integral part of the present description.

All of the scenarios presented can be supported by specific "maintenance and repair positions". Thus, after the package-forming unit, for example incomplete or defective packages could be driven to parked positions by means of switch systems. Applying cover sheets with information about the state and the exact defect thus makes the operator's work easier.

Instead of cover sheets, it is of course also possible to visually mark the products or subproducts by means of applied colour markings and/or enclosed marker slips. In addition to the simply good/bad information, very precise messages about the precise position of the incomplete product in the stack can be given by means of these systems.

FIG. 1 is the schematic view of a production process. The process is divided up into three regions: pre-press A, printing B and processing C.

The printed products 30*a* produced by means of a digital printing machine 2, which are created on the basis of the production process shown here, arrive, after the stacking 4 thereof, which takes place in a processing machine, as packages at an perfect binder 5 and/or at a saddle stitcher 8, in which the processing into books, book blocks and booklets takes place. In all cases, the starting point is a stack 4 formed by a gathering machine, which stack consists of print sheets and/or signatures and/or individual sheets and is formed or compiled according to particular criteria with respect to the quality of the final products of the print job. Any processing of the printed products after the stack formation can of course be carried out individually by means of appropriate branches. Auxiliary gluing ensures that the stack maintains a physical consistency.

The physical manufacturing process begins with establishing a printing substrate web 1, which originates from a feeding device which is arranged upstream. The subsequent digital printing machine 2 is thus fed continuously. Downstream of the digital printing machine 2, the substrate web 1, which is preferably printed on both sides, is supplied to a processing machine 3, in which the signatures/print sheets are produced by means of a plurality of processing steps to form the stack. A processing machine 3 of this type essentially consists, according to requirements, of transverse folding and/or longitudinal folding means of cutting units. In this context, it can readily be provided that firstly a plurality of partial stacks can be formed side-by-side, which are then transferred to a main stack which is compiled according to particular criteria, as is symbolised in FIG. 1, position 4.

If the production is firstly based on partial stacks, then a first embodiment consists in one or more folds firstly being carried out over the entire width of the printed paper web. Subsequently, after a fold/folds has/have been carried out, the individual print sheets are cut to a particular width in the longitudinal direction of the paper web and then each supplied to a particular stack as signatures. Thus, if the width of the printed paper web is divided up for example into four longitudinal webs, then four partial stacks arranged in parallel are also provided.

However, it is also possible to cut the underlying longitudinal webs before folds are carried out, i.e. the folding takes place in this case transversely to the cuts already carried out in the longitudinal direction of the printed paper web, so that there is a number of coordinate signatures corresponding to the number of partial webs created previously.

If double or multiple folding is taken as a basis, then signatures of four or eight double-sided printed pages are produced in each case. Regardless, the cuts in the longitudinal direction of the printed paper web can also be carried out in this case before or after the folds, similarly to the above explanations in the case of a single fold.

A specific sequence of the signatures and/or of individual sheets within the stack 4 forms the basis for the subsequent formation of individual printed products, and this is irrespective of whether the stack 4 is produced originally or by merging various partial stacks.

This essentially means that the printed products which are present in the stack in a "dormant" state, whether they are books, book blocks or booklets, have the same quantitative composition and sequence after processing as the products already forming the basis of the (main) stack.

In this context, according to stack 4, the individual printed products are denoted by 30*a*, 30*b* . . . 30*n*. The processing of the individual printed products takes place individually in the perfect binder 5, whereas the header, footer and front-trim cutting of the printed product, for example in a three-knife trimmer 6, is carried out individually or via a package formation, which is advantageously formed in the case of relatively thin booklets.

The (main) stack can thus have a specific sequence of print sheets, signatures and/or individual sheets, which, when the stack is broken up, lead to printed products having the same or different thicknesses, having the same or different formats, having the same or different sizes. The stack is thus equipped with corresponding auxiliary means which provide a mechanical and/or electronic delimitation between the individual printed products.

In this context, it is also possible to provide the individual signatures and sheets with control codes which allow the related components of the stack to be separated and joined.

However, if a separation of the individual printed products can already be carried out after the stack, the subsequent processing, for example in an perfect binder 5 or a saddle stitcher 8, can be carried out sequentially, i.e. the packaging device 7 of the individual printed products then maintains the sequence which has already been taken as a basis in the stack in terms of content, i.e. there is congruence between the original stack 4 and the downstream package formation 7 of the individual printed products with respect to the qualitative and quantitative sequence.

The above-mentioned aims can be achieved by means of a (central) workflow system 100, wherein said system is supplied with the meta data mentioned below, wherein there is still interdependence between the workflow system 100, the pre-press 130, the digital printing machine 2 and the processing machines 3-8.

The workflow system 100 is supplied by means of at least the following carriers or process data:

gray box JDF 101;
run list 102;
PDF 103;
PDF/VT 104.

The above-mentioned carriers 101-104 and the meta data thereof can be activated individually or according to requirements in any desired combination and interdependence with respect to one another.

This means that the editor 105 in the workflow system 100 is able to create or calculate a JDF (job ticket) from a PDF 103 or PDF/VT 104, wherein the PDF can be supplemented with additional information, such as the paper to be used, which targets the desired starting product.

Since the workflow system 100 knows the parameters of the printing substrate web 1, the controlled machines 3-8 and the digital printing machine 2 including the processing parameters and limits thereof, the mentioned editor can calculate an optimum production process on this basis and reproduce it as a JDF (job ticket).

In the case of the initial job, one or more PDFs (customer inputs) 103 and/or one or more PDF/VTs (data formats for additional meta data) 104 are used to process printed products having fixed or variable contents, thicknesses and formats.

When preparing the work, either a job folder is created in the editor 105 of the workflow system 100, or an MIS (management information system) 121 sends a gray box JDF (job definition format) 101 to the workflow system 100.

In the editor 105, the operator selects the PDF(s) 103 and/or PDF/VT(s) 104, selects the paper and can optionally select additional parameters such as the colour profile of the printing machine and desired printed marks (codes), etc.

On this basis, the editor 105 creates a JDF (job definition format) in the sense of a job folder.

In the case of importing a gray box JDF 101 by means of an MIS (management information system) 121, there is a reference to the PDF(s) 103 to be produced and the relevant paper formats and printing settings. The workflow system 100 reads these values and, on this basis (similarly to the above-described case under a) expands the gray box JDF 101 to a JDF.

The MIS 121 can thus send not only a gray box JDF 101, but also a run list 102 to the workflow system 100.

In this case, the run list 102 contains generally applicable information for the process.

The JDF then created in the workflow system 100 is automatically transmitted to the pre-press 130. Said pre-press reads the relevant processing parameters from the JDF, fetches the PDF(s) (customer input(s)) according to at least one link in the JDF, and imposes said PDF(s). The result is an imposed PDF file. The successful imposition is reported back to the workflow system 100.

As an output, the pre-press 130 thus supplies an imposed PDF, which is then accordingly printed by the digital printing machine 2. The pre-press 130 thus converts the individual pages of a PDF into a new PDF (imposed PDF) in which the individual pages are arranged so that after printing, folds lie in the correct sequence.

With regard to the production, the JDF (job definition format) is sent from the workflow system 100 to a print manager (digital front end) 108 to control the digital printing machine 2, which then controls the digital printing machine accordingly.

At the same time, the JDF is also sent to a line control 109 in conjunction with the processing, which in turn controls the arranged processing machines 3-8 accordingly.

Said line control 109 is optionally provided for processing machines, wherein it is also possible to provide said line control only for one part of the processing machines. A plurality of line controls are not excluded.

Furthermore, the processing machines can optionally directly or semi-directly receive, interpret and accordingly adjust the JDF.

Furthermore, additional process data 112, preferably in the sense of an imposition, can be introduced into the workflow system 100 with process-relevant variable parameters, which preferably relate to the individual printed product. Depending on the configuration of the underlying process in terms of mechanics and control, these parameters allow a specific embodiment within the overall processing, including the digital printing machine.

The overarching goal in the introduction of these variable parameters consists inter alia in coordinating the processing of printed products which do not have a fixed format and have variable thicknesses, such that even long process chains can be carried out and seamless transitions from one production process to the next or the next but one can be achieved.

From all of this data input in the production process, the print job is defined to the digital printing machine 2 and transmitted by means of an open/closed-loop control line 111, wherein this information is also passed on to all of the additional machines 3-8 in the production process and to the printing substrate web 1 simultaneously or subsequently, integrally or in stages. In the sense of a control, the above-mentioned machines communicate with the workflow system 100, as can be seem from the control lines 120 shown, which pass on control information.

It is readily possible for specific machines in such a production process to have to have a particularly great interdependence with respect to one another so that arrangements have to be made for overriding controls or control interventions, such as represented by the lines 113 (between the data flow of the digital printing machine 2 and the printing substrate web 1) and the lines 114 (information between the processing 3 and the data flow to the digital printing machine).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for the production of a print job by sequential or quasi-sequential digital printing, the method comprising:

forming at least one stack including at least one of signatures, print sheets and individual sheets produced by the digital printing, wherein the formation of the stack and components thereof is carried out by means of production-related data or data sets which, by means of at least one workflow system, firstly select a specific sequence of book-related individual printed products made of the stack, and which secondly control a layout of the individual printed products having same or different thicknesses and/or formats and/or having same or individual contents, wherein the workflow system is directly or quasi-directly or indirectly operatively connected to at least one pre-press, wherein at least one of the following operations is performed:

the pre-press recognises a job folder having all of the relevant parameters;

a job ticket is automatically assigned to the pre-press, for which processing machines then prepare;

as soon as the processing machines are ready for processing, to the extent that paper from the appropriate job is taken in, a standby message appears, and production starts only once a digital printing machine and the workflow system report a set-up process as complete; and performing at least one additional processing on the at least one stack so as to produce one or more book-related printed products.

2. The method according to claim 1, wherein the book-related printed products are books, book blocks and booklets.

3. The method according to claim 1, wherein the workflow system is directly or quasi-directly or indirectly operatively connected to at least one of:

at least one digital printing machine;

at least one editor;

at least one print manager;

at least one line control; or all processing machines operating upstream and downstream of a digital printing machine.

4. The method according to claim 1, wherein the workflow system consists of at least the following modules, which are used individually or in any desired combination with one another:

a module for informative, transparent production with a continuous report on a status of production lines and respective jobs;

a module for informative, transparent production with a continuous report on the status of the production lines and respective jobs, wherein the entire production is displayed and analysed by means of graphs;

a module for creating and editing jobs for clients using client software;

a module for scheduling the jobs in a sense of sorting, grouping and planning, regardless of the degree of automation and the software programmes of the machine;

a module for recording and storing operating data resulting from the production, formation and processing, provided that said data are continuously available;

a module for providing operating data for printing cover sheets for book blocks and logistics documents which correspond to effectively produced products;

a module for an overriding check of the operating data implemented and the interdependent module-dependent processes during the production and formation of the products;

a module for error messages/warnings in the event of deviations from a target state and use of related correction programs and/or elimination processes with respect to the products affected by deviations.

5. The method according to claim 1, wherein the at least one of signatures and individual sheets are interconnected during the stack formation by means of an auxiliary gluing station, and wherein the auxiliary gluing station is directly or quasi-directly or indirectly operatively connected to the workflow system.

6. The method according to claim 1, wherein at least units including the workflow system, pre-press, printing substrate web, digital printing machine and processing machines operate individually or interdependently with respect to one another by means of control lines to the units and by means of control information from the units.

7. The method according to claim 1, wherein the pre-press codes the printed products according to codes specified by an editor.

8. The method according to claim 1, wherein the pre-press triggers impositioning, in which:

meta data emerging from at least one data format relate to predefined web widths and/or product types;

the meta data are printed on the printed product as encoded information;

additional visual markings or texts are added in the paragraph or viewing region, in order to make it possible for the operator to recognise and assign the subproducts/final products.

9. The method according to claim 1, wherein a created JDF (job definition format) is automatically transmitted to the pre-press, wherein the pre-press reads the relevant processing parameters from the JDF in operative connection with at least one integrated PDF (customer input), wherein a PDF file is imposed, and wherein the imposition carried out is reported back to the workflow system.

10. The method according to claim 1, wherein a JDF (job definition format) is sent from the workflow system to a print manager, and wherein the print manager controls a digital printing machine.

11. The method according to claim 1, wherein the pre-press provides at least the following processes:

as soon as the processing machines are ready for processing, to the extent that paper from the appropriate job is taken in, the standby message appears, and production starts or is authorised only once the digital printing machine and the workflow system report the set-up process as complete.

12. The method according to claim 1, wherein a JDF (job definition format) is sent from a line control, which directly or indirectly controls all of the processing machines acting downstream of the digital printing machine.

13. The method according to claim 1, wherein the workflow system is supplied with at least one of the following items of process data:

a gray box JDF;

a run list;

a PDF; and a PDF/VT, wherein, upon the workflow system being supplied with a plurality of process data, said data are introduced in any desired combination and order.

14. The method according to claim 1, wherein an editor interprets a run list as processes, and wherein a PDF/VT supplies at least one of the pre-press and the digital printing machine with additional meta data.

15. The method according to claim 1, wherein the workflow system is supplied with additional process data.

16. The method according to claim 1, wherein the workflow system is operatively connected to at least one MIS introduced from outside which introduces at least one of at least one additional gray box JDF and a run list into the workflow system.

17. The method according to claim 1, wherein individual printed products produced by the digital printing as the components of the stack are differentiated from one another and are retrievable for processing by means of at least one of a physical delimitation and an electronic delimitation.

18. The method according to claim 1, wherein individual printed products produced by the digital printing as the components of the stack are finished off by means of at least one processing in saddle stitchers, perfect binders and book sewing machines.

19. The method according to claim 1, wherein the printed products are provided with a cover at least during the final processing in a processing machine.

20. The method according to claim 1, wherein at least PDF or PDF/VT formats contain meta data relating to covers of the printed products, and in that the covers are assigned to the respective printed products variably and individually.

21. The method according to claim 1, wherein processing of the data or data sets works as a backward strategy (job ticket for processing>pre-press>printing).

* * * * *